US006949719B2

(12) United States Patent
Suenaga et al.

(10) Patent No.: US 6,949,719 B2
(45) Date of Patent: Sep. 27, 2005

(54) THERMAL INSULATOR HAVING A HONEYCOMB STRUCTURE AND HEAT RECYCLE SYSTEM USING THE THERMAL INSULATOR

(75) Inventors: Osamu Suenaga, Nirasaki (JP); Wataru Okase, Kanagawa (JP); Takenobu Matsuo, Tosu (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 10/831,111

(22) Filed: Apr. 26, 2004

(65) Prior Publication Data

US 2004/0195230 A1 Oct. 7, 2004

Related U.S. Application Data

(63) Continuation of application No. 10/026,946, filed on Dec. 27, 2001, now Pat. No. 6,756,565.

(30) Foreign Application Priority Data

Dec. 28, 2000 (JP) ..... 2000-402104
Dec. 19, 2001 (JP) ..... 2001-386110

(51) Int. Cl.[7] ..... F27B 5/14

(52) U.S. Cl. ..... 219/390; 219/405; 219/411; 118/724; 118/725; 392/416; 392/418; 428/73; 428/116; 428/117; 55/523

(58) Field of Search ..... 219/390, 405, 219/411; 392/416, 418; 118/724, 725, 50.1; 428/73, 116–117; 55/523; 156/89; 422/180; 502/527; 110/356; 427/234; 52/746

(56) References Cited

U.S. PATENT DOCUMENTS 4,602,769 A * 7/1986 Crum ..... 266/259
4,740,406 A 4/1988 Narumiya et al.
6,040,064 A * 3/2000 Bruck et al. ..... 428/593

FOREIGN PATENT DOCUMENTS

| | | |
|---|---|---|
| JP | 60-80077 | 5/1985 |
| JP | 1-75855 | 5/1989 |
| JP | 06-048860 | 2/1994 |
| JP | 06-0565551 | 3/1994 |
| JP | 07-206540 | 8/1995 |
| JP | 07-277719 | 10/1995 |
| JP | 08-188489 | 7/1996 |
| JP | 09-076036 | 3/1997 |

* cited by examiner

*Primary Examiner*—Shawntina Fuqua
(74) *Attorney, Agent, or Firm*—Pillsbury Winthrop Shaw Pittman LLP

(57) ABSTRACT

A thermal insulator can change a heat insulation characteristic partially with a simple structure. The thermal insulator is divided into a plurality of parts in accordance with a temperature of a heat source which is insulated by the thermal insulator. The plurality of parts are formed of different honeycomb structures, respectively, so as to provide different heat insulation characteristics. The plurality of parts may be formed by different materials, or a shape or dimension such as a cell pitch of the honeycomb structure may be varied. Heat is collected from air within the honeycomb cells, and is transferred to other parts for heating.

14 Claims, 10 Drawing Sheets

| | CONVENTIONAL TECHNIQUE | SUGGESTED TECHNIQUE 1 | SUGGESTED TECHNIQUE 2 |
|---|---|---|---|
| | STEEL PLATE | HONYCOMB STRUCTURE PANEL VENTILATED | HONYCOMB STRUCTURE PANEL VENTILATED |
| CONDITION |   |   |   |
| AMOUNT OF HEAT RELEASED | 314 W/m2 | 241 W/m2 | 56 W/m2 |
| | 270 kcal/m2·hr | 207 kcal/m2·hr | 48 kcal/m2·hr |

THERMAL INSULATOR HAVING A HONEYCOMB STRUCTURE AND HEAT RECYCLE SYSTEM USING THE THERMAL INSULATOR

RELATED APPLICATIONS

This is a continuation of U.S. patent application Ser. No. 10/026,946, filed Dec. 27, 2001, now U.S. Pat. No. 6,756,565 the contents of which are incorporated herein in their entirety by reference. This application also claims priority to Japanese Patent Application Nos. 2000-402104, filed Dec. 28, 2000, and 2001-386110, filed Dec. 19, 2001.

BACKGROUND OF THE INVENTION

1. Field of the Invention

The present invention relates a thermal insulator and, more particularly, to a thermal insulator provided to a heat treatment apparatus used for a semiconductor manufacturing apparatus and a heat recycle system using such a thermal insulator.

2. Description of the Related Art

Since a temperature of a heat treatment furnace, which applies a heat treatment to a semiconductor wafer, becomes very high, a thermal insulator is provided around the heat treatment furnace. That is, heat released from an electric heater for heating the heat treatment furnace is shielded by the thermal insulator so as to prevent the heat from leaking outside of the heat treatment furnace.

Conventionally, such kind of thermal insulator is formed of so-called ceramics wool. The ceramics wool is made of fine fibers of minerals, and the ceramics wool is provided around the heat treatment furnace in the form of a fabric or a board. The thermal insulation of the ceramics wool is achieved by a very low thermal conductivity of minerals, which are materials of the ceramics wool, and tiny spaces formed between the fibers.

Japanese Laid-Open Patent Application NO. 60-80077 discloses a method of insulating a furnace by constituting outer walls of the furnace using a heat insulation member having a honeycomb structure. In this method, an airflow passage is formed by internal spaces of the honeycomb structure member. The furnace is insulated and cooled by passing a cooling air through the airflow passage. Moreover, it is suggested to collect the air used for cooling and store the heat of the air in a thermal storage apparatus or use the collected high-temperature as a combustion air for the furnace.

A heat treatment apparatus of a semiconductor manufacturing apparatus has a structure in which a heat treatment furnace and a conveyance mechanism for conveying semiconductor wafers are provided inside a housing. Therefore, when a heat-treated semiconductor wafers are taken out of the heat treatment furnace, the housing of the heat treatment apparatus is heated. For example, if a heat treatment temperature of the semiconductor wafers is 1000° C., the semiconductor wafers after the heat treatment will be taken out of the heat treatment furnace at a temperature of about 800° C. Therefore, the housing of the heat treatment apparatus is heated by the hot air exhausted from the heat treatment furnace together with the semiconductor wafers. Moreover, the housing is partially heated by the radiation heat of the semiconductor wafers taken out of the furnace.

As mentioned above, the thermal insulator, which insulates the circumference of the heat treatment furnace of the heat treatment apparatus, is formed of a material such as ceramics wool, and if the heat treatment furnace is covered by the thermal insulator having a uniform thickness, any portion of the heat treatment furnace will be provided with uniform heat insulation efficiency. A vertical furnace, which is widely used from among heat treatment furnaces, has a vertical length as long as more than 1 meter. If such a vertical furnace is uniformly heated in the vertical direction by an electric heater, variation in the temperature may occur in the vertical direction of the furnace. That is, since the heated air moves upward within the vertical furnace, a temperature of an upper portion becomes higher than a temperature of a lower portion of the vertical furnace. In order to apply a uniform heat treatment to the semiconductor wafers provided in the vertical furnace, such a variation in the temperature must be eliminated as much as possible.

Then, in a conventional vertical furnace, a power supplied to the electric heater is controlled so that an amount of heat generated by the electric heater in an upper portion of the vertical furnace is larger than an amount of heat generated in a lower portion of the furnace. That is, the power supplied to the electric heater is increased toward a bottom of the vertical furnace. Generally, an electric heater is located in the vicinity of an inner wall of an insulator, which surrounds the vertical furnace. If the thickness of the insulator is uniform, that is, if the insulation efficiency of the insulator is uniform, there is a problem in that the heat of a lower portion of the vertical furnace passing through the insulator and released to the atmosphere is larger than the heat of an upper portion of the vertical furnace passing through the insulator and released to the atmosphere.

In the conventional thermal insulator using ceramics wool, in order to change the heat insulation characteristic, only a control, which merely changes a thickness of the thermal insulator, can be performed and a fine control cannot be achieved. On the other hand, the heat insulation characteristic of the honeycomb structure thermal insulator disclosed in the above-mentioned Japanese Laid-Open Patent Application No. 60-80077 can be changed by controlling a quantity of air flowing through inside of the thermal insulator. However, the heat insulation characteristic can be merely changed with respect to the entire honeycomb structure thermal insulator, and the heat insulation characteristic cannot be changed partially.

Moreover, in the thermal insulator using ceramics wool, a heat treatment furnace cannot be cooled forcibly. Therefore, in order to lower the temperature of the furnace after completion of a heat treatment so as to take out semiconductor wafers from the furnace, it cannot but depend only on cooling by exhausting air in the heat treatment apparatus. For example, in order to lower the temperature of a 1000° C. semiconductor wafer to 800° C., the semiconductor wafer after the heat treatment must be remain inside the heat treatment furnace for a long time. Therefore, there is a problem in that the heat treatment process time of a semiconductor wafer is long.

Moreover, generally a housing of a heat treatment apparatus is formed with a steel plate or the like. If a high-temperature semiconductor wafer is taken out of a vertical furnace within a heat treatment apparatus, a portion of a housing near the semiconductor wafer is heated by radiation. Thus, the heat in the heat treatment apparatus is released to a clean room through the housing, thereby increasing a temperature inside the clean room. For this reason, a load is applied to the air-conditioner for maintaining the clean room air at a constant temperature, and a running cost of the clean room increases. Therefore, in order to prevent a heat generated within a heat treatment apparatus from being released to the clean room through the housing, the housing itself is formed by a thermal insulator and heat insulation efficiency is increased partially.

SUMMARY OF THE INVENTION

It is a general object of the present invention to provide an improved and useful thermal insulator in which the above-mentioned problems are eliminated.

A more specific object of the present invention is to provide a thermal insulator which can change a heat insulation characteristic partially with a simple structure.

Another object of the present invention is to provide a thermal insulator which can be cooled per se while insulating a heat source.

A further object of the present invention is to provide a thermal insulator which allows recycle of heat collected by cooling the thermal insulator, and a heat recycle system using such a thermal insulator.

In order to achieve the above-mentioned objects, there is provided according to one aspect of the present invention a honeycomb structure thermal insulator for intercepting a heat released from a heat source, comprising: a plurality of parts defined by dividing the honeycomb structure thermal insulator in accordance with a temperature of the heat source, the plurality of parts being formed of different honeycomb structures, respectively, so as to provide different heat insulation characteristics.

In the honeycomb structure thermal insulator according to the present invention, the plurality of parts may be formed of different materials. Additionally, each of the materials of the honeycomb structures may contain a mixture of alumina fiber and silica fiber so that the materials are formed in different compositions by varying a mixing ratio of the alumina fiber and the silica fiber. Further, the plurality of parts may be provided with different heat insulation characteristics by varying a weight per unit volume of the honeycomb structure. The weight per unit volume of the honeycomb structure may be varied by changing a cell pitch of the honeycomb structure.

The honeycomb structure thermal insulator according to the present invention may further comprise air supply means for supplying air to the honeycomb structure so that each cell of the honeycomb structure serves as an air passage. Additionally, the honeycomb structure thermal insulator may further comprise a coolant passage through which a coolant flows so as to cool the air flowing trough the air passage defined by each cell.

When the heat source is an electric heater provided around a vertical heat treatment furnace, the honeycomb structure thermal insulator may have a cylindrical shape so as to substantially enclose the electric heater and the honeycomb structure thermal insulator may be divided into the plurality of parts in a radial direction of the honeycomb structure thermal insulator.

When the heat source is an electric heater provided around a vertical heat treatment furnace, the honeycomb structure thermal insulator may have a cylindrical shape so as to substantially enclose the electric heater and the honeycomb structure thermal insulator may be divided into the plurality of parts in a vertical direction of the honeycomb structure thermal insulator. Additionally, the plurality of parts may be defined by dividing the honeycomb structure thermal insulator in accordance with heat control zones of the electric heater.

Additionally, there is provided according to another aspect of the present invention a honeycomb structure thermal insulator for intercepting heat released from a heat source, comprising: a plurality of cells constituting a honeycomb structure; and a coolant passage through which a coolant flows so as to cool air in the cells.

Further, there is provided according to another aspect of the present invention a heat recycle system for reusing heat collected by a thermal insulator, the heat recycle system comprising: a honeycomb structure thermal insulator for insulating a heat treatment furnace of a heat treatment apparatus; heat collecting means for collecting heat from inside the honeycomb structure thermal insulator; heat transfer means for transferring the collected heat to a predetermined part; and heating means for heating the predetermined part by the heat transferred by the heat transfer means.

In the heat recycle system according to the present invention, the heat collecting means may include a coolant passage through which a coolant flows so as to cool air inside the honeycomb structure thermal insulator, and the heat transfer means may include a coolant supply passage for transferring the coolant discharged from the coolant passage to the predetermined part.

The predetermined part may be a manifold provided to the heat treatment furnace. Also, the predetermined part may be an external combustion apparatus connected to a manifold provided to the heat treatment furnace. The predetermined part may be a material gas supply passage for supplying a material gas to a manifold connected to the heat treatment furnace. The predetermined part may be an exhaust passage for exhausting an exhaust gas from a manifold connected to the heat treatment furnace.

As mentioned above, according to the present invention, a thermal insulator of which heat insulation characteristic can be changed partially with a simple structure by using a honeycomb structure as the thermal insulator. Additionally, according to the present invention, the thermal insulator itself can be cooled while insulating a heat source by the honeycomb structure thermal insulator, and, can be collected from the honeycomb structure thermal insulator and reused as a heat source for other parts.

Other objects, features and advantages of the present invention will become more apparent from the following detailed descriptions when read in conjunction with the accompanying drawings.

DETAILED DESCRIPTION OF THE PREFERRED EMBODIMENT

A description will now be given, with reference to the drawings, of an embodiment of the present invention.

Figure 1:
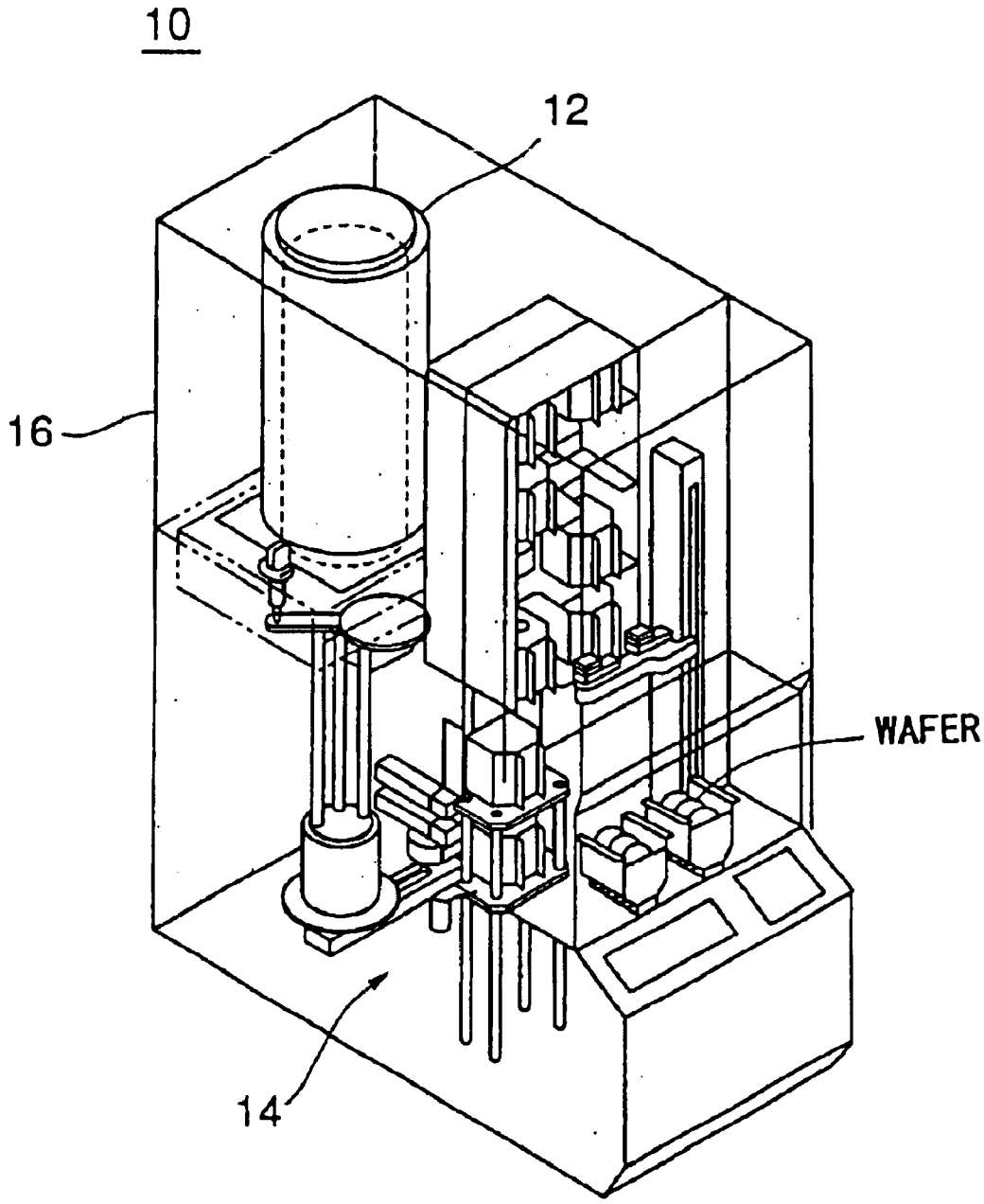
FIG. 1 is a perspective view of a heat treatment apparatus according to a first embodiment of the present invention.

FIG. 1 is a perspective view of a heat treatment apparatus according to an embodiment of the present invention. A conveyance mechanism 14 is provided near the vertical heat treatment furnace 12 so as to take semiconductor wafers in and out of the vertical heat treatment furnace 12. The vertical heat treatment furnace 12 and the conveyance mechanism 14 are accommodated in a housing 16.

Figure 2:
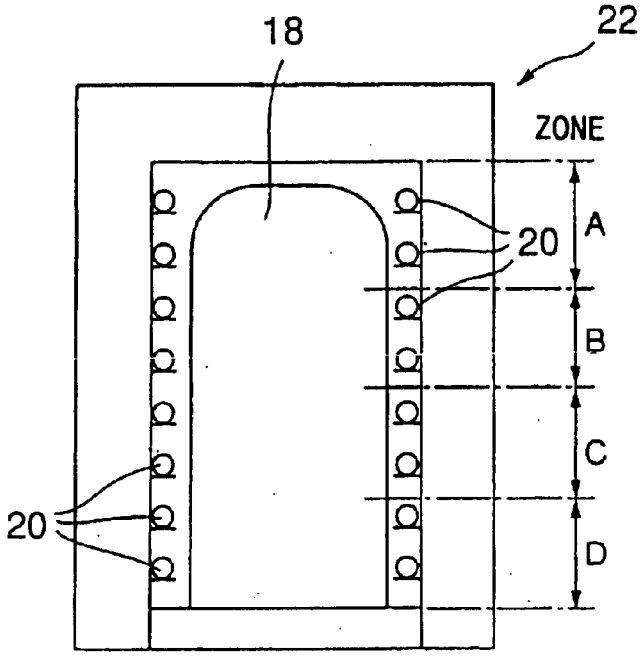
FIG. 2 is a schematic side view of a vertical heat treatment furnace shown in FIG. 1.

FIG. 2 is a schematic side view of the vertical heat treatment furnace 12 shown in FIG. 1. The vertical heat treatment furnace 12 has a wafer accommodation container 18 formed of quartz glass, etc. A plurality of semiconductor wafers are accommodated in the wafer accommodation container 18 in a state in which the wafers are arranged along a vertical direction. In order to accommodate more than 100 wafers at once, a vertical length of the wafer accommodation container 18 exceeds 1 m.

An electric heater 20 as a heat source is provided around the wafer accommodation container 18 so as to heat the semiconductor wafers from outside of the wafer accommodation container 18. An outside of the electric heater 20 is covered by a thermal insulator 22. The thermal insulator 22 insulates so that a heat generated by the electric heater 20 dose not leak outside. The electric heater 20 is supported by a support part which extends from an interior of the thermal insulator 22 so that the electric heater 20 is located between the wafer accommodation container 18 and the thermal insulator 22. Since the vertical length of the wafer accommodation container 18 is large, a uniform power is supplied to the entire electric heater 20 so as to heat the wafers, a temperature of an upper part of the wafer accommodation container 18 becomes higher than a temperature of a lower part of the wafer accommodation container 18. Thus, there is a problem in that a heat treatment will be performed on the semiconductor wafers accommodated in the upper portion of the wafer accommodation container 18 at a higher temperature than the semiconductor wafers accommodated in the lower part of the wafer accommodation container 18.

In order to prevent such a variation in the processing temperature, the electric heater 20 is divided into a plurality of zones (portions) in a vertical direction so that a power supply control is performed on an individual zone basis. In the vertical heat treatment furnace 12 shown in FIG. 2, the electric heater 20 is divided into four zones A, B, C and D, and an electric power supplied to each zone is controlled individually. Generally, a control is performed so that the temperature in the wafer accommodation container 18 becomes uniform in the vertical direction by supplying a large power to the lower zones and a small power to the upper zones. Therefore, if the heat insulation characteristic of the thermal insulator 22 is uniform over the lower portion to the upper portion, an amount of heat released from the lower portion is larger than an amount of heat released from the upper portion.

Figure 3:
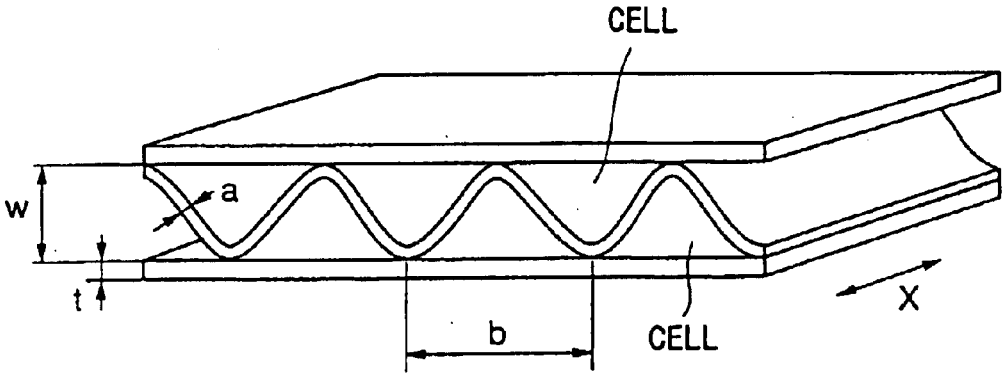
FIG. 3 is a perspective view of a honeycomb structure used for the vertical heat treatment furnace shown in FIG. 2.

The present invention provides a thermal insulator which can change or strengthen a heat insulation characteristic partially with a good heat insulation efficiency by using a honeycomb structure as shown in FIG. 3. The honeycomb structure shown in FIG. 3 is formed by ceramic fibers in the form of a thin board, and a waveform board is sandwiched by two ceramic-fiber boards. Although a honeycomb structure generally refers to a structure in which a plurality of cells having a hexagonal cross section are arranged, a cross section of the cells related to the present invention can be an arbitrary shape. In the present invention, the structure shown in FIG. 3 in which cells are defined by the waveform board is also referred to as a honeycomb structure.

In the present invention, the heat insulation characteristic is partially changed by partially changing the material of a honeycomb structure Moreover; the heat insulation characteristic can be partially changed also by changing the material thickness "a" and "t", a cell pitch "b", a cell width "w", etc., shown in FIG. 3. Furthermore, the heat insulation characteristic can be partially changed also by changing a longitudinal direction (direction indicated by an arrow X in FIG. 3) of the cells of the honeycomb structure.

Figure 4:
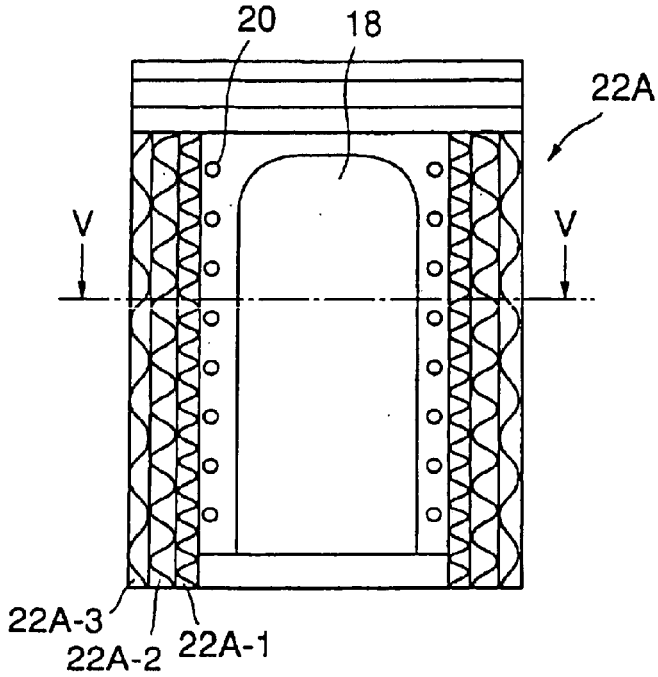
FIG. 4 is an illustration showing a structure of a thermal insulator according to the first embodiment of the present invention.
Figure 5:
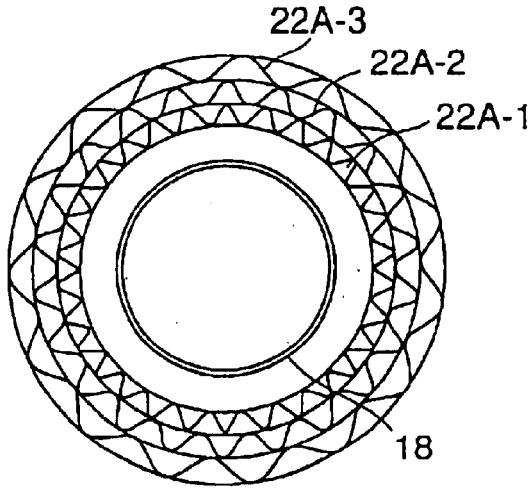
FIG. 5 is a cross-sectional view taken along a line V—V of FIG. 4.

A description will now be given of a thermal insulator according to a first embodiment of the present invention. FIG. 4 is an illustration showing a structure of the thermal insulator according to the first embodiment of the present invention. FIG. 5 is a cross-sectional view taken along a line V—V of FIG. 4. The first embodiment of the present invention is applied to the thermal insulator 22, which is provided for insulating the vertical heat treatment furnace 12 of the heat treatment apparatus 10 shown in FIG. 1.

The thermal insulator 22A shown in FIG. 4 is provided around the electric heater 20 so as to enclose the wafer accommodation container 18 and the electric heater 20. The thermal insulator 22A is divided into a plurality of layers (portions) 22A-1, 22A-2 and 22A-3 in a radial direction, and each layer is constituted by a different honeycomb structure. It should be noted that although the thermal insulator 22A is formed in a cylindrical shape, the insulator 22A may be formed in a polygonal column shape such as an octagonal column shape if the thermal insulator 22A can substantially enclose the wafer accommodation container 18 and the electric heater 20. If the thermal insulator 22A is formed in a polygonal column shape, the thermal insulator 22A can be formed by connecting a plurality of flat honeycomb structure boards.

In the present embodiment, a mixture of alumina fiber ($Al_2O_3$) and silica fiber ($SiO_2$) is used as the material of the honeycomb structure, and the heat insulation characteristic is changed by changing a mixture ratio thereof. That is, a honeycomb structure containing 95% alumina fiber and 5% silica fiber is used for the inner layer (portion) 22A-1; a honeycomb structure containing 64% alumina fiber and 36% silica fiber is used for the intermediate layer (portion) 22A-2; and a honeycomb structure containing 36% alumina fiber and 64% silica fiber is used for the outer layer (portion) 22A-3.

The mixture of alumina fiber and silica fiber serves as a material excellent in heat resistance as a ratio of the alumina fiber is increased. On the other hand, the silica fiber serves as a material excellent in thermal insulation characteristic as a ratio of the silica fiber is increased since the thermal conductivity of the silica fiber is low as compared to the alumina fiber. Moreover, the silica fiber serves as a material strong against a temperature change as the ratio of the silica fiber is increased since the thermal expansion rate of the silica fiber is smaller than that of the almina fiber.

Since the electric heater 20 is located close to an inner surface of the thermal insulator 22A of the vertical heat treatment furnace 12, a temperature of the inner layer 22A-1 of the thermal insulator 22A reaches 1200° C. to 1300° C., and, thus, a high thermal resistance is required for the inner layer 22A-1. Therefore, the inner layer 22A-1 is formed by a honeycomb structure having a large ratio (95%) of the almina fiber so as to withstand a direct heat from the electric heater 20.

Moreover, since a material having a larger ratio of alumina fiber has a higher thermal conductivity, a high-temperature portion can be smoothed in a certain degree in the inner layer 22A-1 even if there is variation in the heating temperature of the electric heater.

On the other hand, considering the heat insulation characteristic, a material having a large ratio of silica fiber is preferable. Then, in the present embodiment, a material containing a larger ratio of silica fiber than that of the inner layer 22A-1 is used for the middle layer 22A-2, and a material having a further larger ratio of silica fiber is used for the outer layer 22A-3. Middle layer 22A-2 is provided for the reason that the thermal expansion rate of the material decreases as the ration of the silica fiber increases. That is, a difference between the thermal expansion rates of the materials is large when the ration of silica fiber is sharply increased, which may cause a problem.

As mentioned above, the thermal insulator which has an outstanding heat resistance and outstanding heat insulation characteristic, and also has a stability in the structure thereof can be achieved by dividing the thermal insulator 22A into a plurality of layers (portions), forming an inner layer by a honeycomb structure having a heat resistance, and forming an outer layer by a honeycomb structure having an excellent heat insulation characteristic.

Although the thermal insulator which has both the heat resistance and the heat insulation characteristic is achieved by changing the material of each of the layers 22A-1, 22A-2 and 22A-3 in the present embodiment, the thermal insulation characteristic can be changed by changing the shape and size of each of the layers.

For example, a heat insulation characteristic can be increased towards an outside by setting a thickness (indicated by w in FIG. 3) of the inner layer 22A-1 small and increasing the thickness of the layers towards an outside. The heat insulation characteristic can also be increased towards the outside by setting a cell pitch (indicated by b in FIG. 3) of the inner layer 22A-1 small and increasing cell pitches of the layers towards an outside. In addition, the heat insulation characteristic can also be changed by changing a material or dimensions of the honeycomb structure of each layer.

Moreover, a characteristic of the material such as a heat resistance or a thermal expansion rate can be changed. Further, the above-mentioned methods may be combined so as to obtain a thermal insulator having a desired thermal insulator entirely or partially.

The above-mentioned honeycomb structure thermal insulator 22A provides a good heat insulation characteristic by utilizing the heat insulation nature of air inside the cells of the honeycomb structure. In addition, a large heat insulation characteristic can be obtained as a thermal insulator by passing air through the cells so as to eliminating a heat from an interior of the thermal insulator. Namely, the thermal insulator 22A itself can be cooled by passing air through the cells of the honeycomb structure in a longitudinal direction (a direction indicated by an arrow X in FIG. 3) of the cells so as to cool the inner side of the heat insulation structure, which results in a higher heat insulation characteristic.

For example, each layer of the thermal insulator 22A is arranged so that the longitudinal direction of the cells matches a vertical direction so as to introduce an air into each cell from a vertically lower portion and exhaust the air from un upper portion. Thereby, the heat entering the thermal insulator 22A can be absorbed by the air flowing through the cells and discharged outside the thermal insulator 22A.

Figure 6:
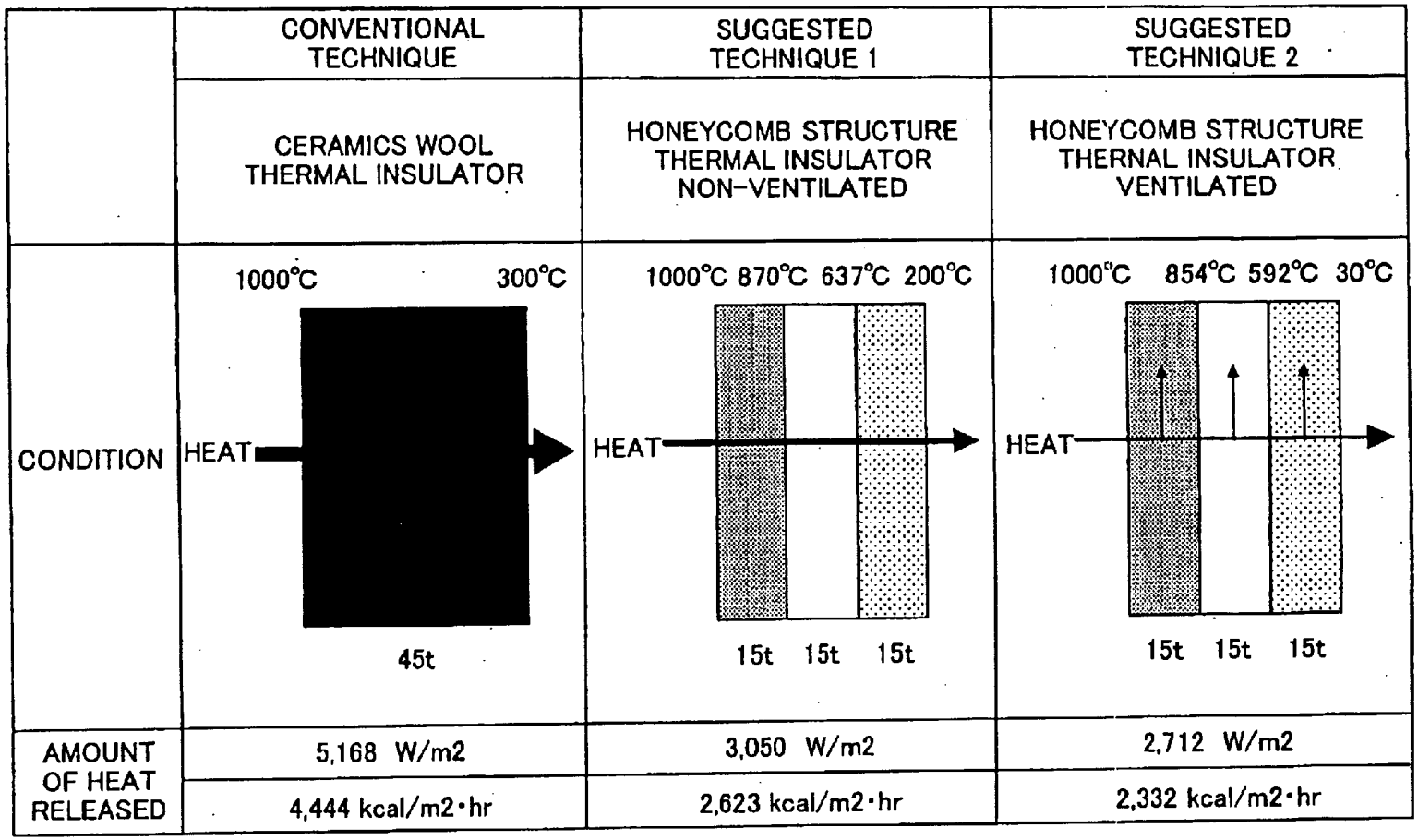
FIG. 6 is an illustration of a result of calculation with respect to an amount of heat released through various panels.

FIG. 6 shows the result of calculation of an amount of heat transfer of a ceramics wool thermal insulator, the honeycomb structure thermal insulator 22A according to the present embodiment and the honeycomb structure thermal insulator 22A with air ventilation.

In FIG. 6, the case where the ceramics wool thermal insulator (almina-silica) is used is shown on the left side as a conventional technology. On the assumption that a temperature inside the thermal insulator is 1000° C. and a temperature of outside is 300° C., the result of calculation of the amount of heat released from the thermal insulator by passing through the thermal insulator is 5,168 W per square meter. That is, an amount of heat of 4,444 kcal passes the thermal insulator per square meter for 1 hour, and is released outside.

On the other hand, a calculation was made with respect to the honeycomb structure, as a suggested technique 1, which is divided into three layers as shown in FIG. 4. It was assumed that a thickness of each of the three layers is set to 15 mm, and the whole thickness is the same as the thickness of the conventional ceramics wool thermal insulator. When the calculation was made on the assumption that a temperature of inside is 1000° C. and outside is 200° C., a temperature of a part between the inner layer and the middle layer was 870° C. and a temperature of a part between the middle layer and the outer layer was 637° C. Moreover, an amount of heat released in this case was 3,050 W per square meter. That is, an amount of heat of 2,623 kcal passes the honeycomb structure thermal insulator per square meter for 1 hour, and is released outside. This amount of heat corresponds to about a half of heat released from the conventional ceramics wool thermal insulator.

Moreover, as a suggested technique 2, a calculation was made on the assumption that air is passed through the three-layered honeycomb structure thermal insulator of the suggested technique 1. In this case, when a temperature of outside the thermal insulator is set to 30° C. since there is an air cooing effect, a temperature of a part between the inner layer and the middle layer was 845 doc and a temperature of a part between the middle layer and the outer layer was 592° C. Moreover, an amount of heat released in this case was 2,712 W per square meter. That is, an amount of heat of 2,332 kcal passes the honeycomb structure thermal insulator per square meter for 1 hour, and is released outside. This amount to heat is slightly smaller than that of the honeycomb structure thermal insulator of the suggested technique 1. Moreover, in the suggested technique 2, the temperature outside the thermal insulator is decreased to 30° C., which is close to a room temperature.

When the cooling air passed through the honeycomb structure as in the suggested technique 2, the temperature of 1000° C. can be reduced even at 30° C. sorely by the thermal insulator. Generally, a cooling-water pipe is provided outside the thermal insulator of the vertical heat treatment furnace 12 so as to cool the outside of the thermal insulator. However, if the structure of the suggested technique 2 is used, there is no need to supply the cooling-water, and the vertical heat treatment furnace 12 can be sufficiently insulated by the thermal insulator alone. Moreover, in the suggested technique 2, if introduction of the air into the thermal insulator is stopped while a heat treatment is carried out on semiconductor wafers, it will become the same condition as the suggested technique 1. That is, is heating is carried out during a heat treatment under the condition of the suggested technique 1 and supply an air to the thermal insulator 22A when decreasing a temperature of the vertical heat treatment furnace 12 after completion of the heat treatment, the furnace 12 can be cooled quickly and a time spent on the heat treatment process can be reduced.

A description will now be given, with reference to FIG. 7, of another example of the first embodiment of the present invention.

Figure 7:
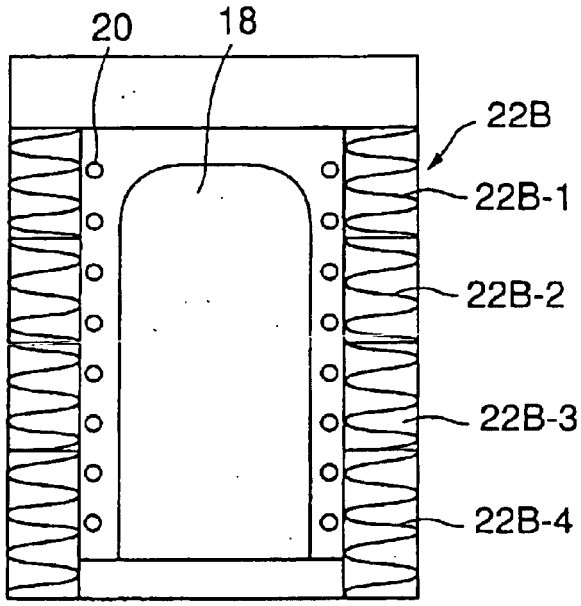
FIG. 7 is a schematic side view of the vertical heat treatment furnace having a thermal insulator according to a variation of the first embodiment of the present invention.

A thermal insulator 22B shown in FIG. 7 differs from the thermal insulator 22A in the method of dividing the thermal insulator. That is, the thermal insulator 22B is divided along a vertical direction while the thermal insulator 22A is divided along a radial direction. Divided portions 22B-1, 22B-2, 22B-3 and 22B-4 generally correspond to the zones A, B, C and D shown in FIG. 2, respectively. That is, since a power supplied to the electric heater differs from zone to zone and an amount of heat generated by the electric heater differs, it is preferred to vary a heat insulation characteristic of each part in response to each zone of the thermal insulator.

Therefore, in the thermal insulator 22B shown in FIG. 7, an appropriate heat insulation characteristic is achieved for each part by partially changing the material or shape of the honeycomb structure thermal insulator in response to each zone A, B, C and D so as to permit a uniform heat being released from the thermal insulator. A change in the material and shape can be the same as that of the thermal insulator 22A shown in FIG. 4, and descriptions thereof will be omitted.

Figure 8:
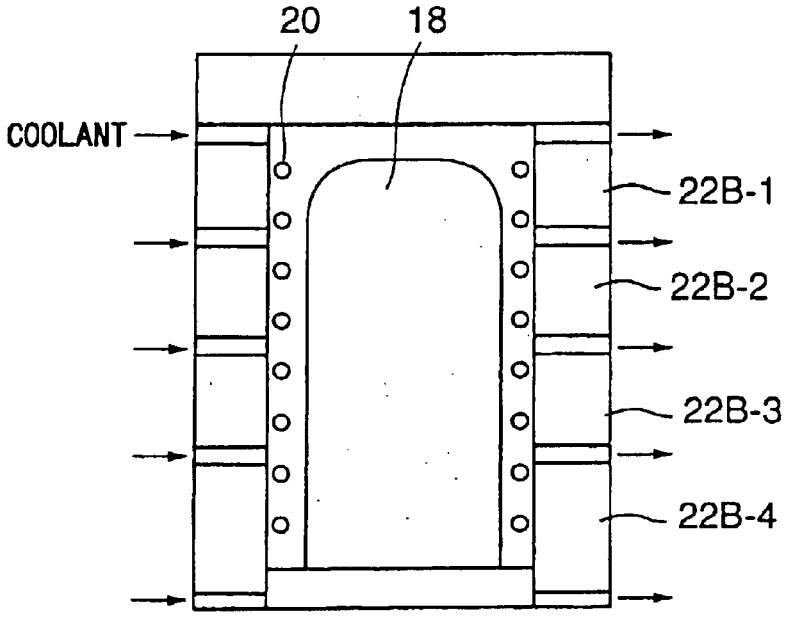
FIG. 8 is a schematic side view of the vertical heat treatment furnace having a thermal insulator according to another variation of the first embodiment of the present invention.

Moreover, as shown in FIG. 8, the air inside the honeycomb structure of each of the portions 22B-1, 22B-1, 22B-3 and 22B-4 of the thermal insulator 22B can be cooled by supplying a coolant such as cooling water to each of the portions 22B-1, 22B-1, 22B-3 and 22B-4. According to such a structure, a heat insulation characteristic can be controlled for each portion, and more suitable heat insulation can be offered.

Figure 9:
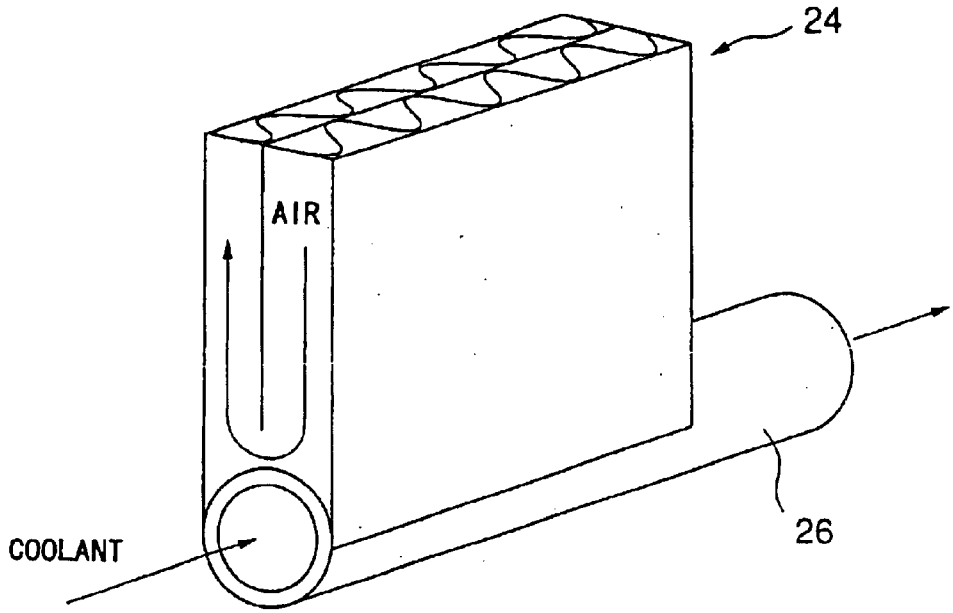
FIG. 9 is a perspective view of a thermal insulator having a coolant supply passage.

FIG. 9 shows an example in which a coolant is supplied to cool the air inside the honeycomb structure. In the example shown in FIG. 9, the air inside the honeycomb structure is ventilated by providing a coolant passage 26 on one side of the honeycomb structure 24 of two layers, and connecting one layer and another layer in the vicinity of the cooling passage 26. In this case, the honeycomb structure 24 functions as a thermal insulator when the supply of the coolant is stopped if supply of a coolant to the cooling passage, and the honeycomb structure 24 functions as both a thermal insulator and a cooling member by being supplied with a coolant.

As mentioned above, in the first embodiment of the present invention, the dividing method of a thermal insulator is not limited to the above-mentioned structure, and, for example, both the radially dividing method shown in FIG. 4 and the vertically dividing method shown in FIG. 7 may be applied to the same thermal insulator.

Moreover, other than the dividing method in the radial and vertical directions, the thermal insulator may be divided along a circumferential direction of the thermal insulator. For example, when the electric heater 20 is not heated at a uniform temperature over the entire portion along a circumferential direction, or when coolant piping is provided on an inner or outer surface of the thermal insulator, there may occur a variation in the thermal insulator along the circumferential direction. In such a case, the heat insulation characteristic may be controlled by dividing the thermal insulator in the circumferential direction.

A description will now be given of a second embodiment of the present invention. In the second embodiment of the present invention, a honeycomb structure thermal insulator is applied to a housing 16 of the eat treatment apparatus shown in of FIG. 1.

Although a panel formed of a steel plate or the like is generally used for a housing of a heat treatment apparatus, a heat insulation characteristic of a steel plate is not so good, and, thus, a large amount of heat is released from the housing to a clean room. Then, in the present embodiment, the honeycomb structure thermal insulator used in the first embodiment is applied to the housing 16 of the heat treatment apparatus 10.

When semiconductor wafers after heat treatment is taken out of the vertical heat treatment furnace 12, a portion of the housing 16 close to the taken-out semiconductor wafers (about 800° C.) receives a radiation from the semiconductor wafers, and, thereby, heat will be released to outside (clean room air) from the portion of the housing 16. In order to prevent such a partial heat release, it is preferable that the portion of the housing 16 close to the semiconductor wafers take out of the vertical heat treatment furnace 12 has strengthened heat insulation than other portions.

Furthermore, when the semiconductor wafers are taken out of the vertical heat treatment furnace 12, the heated air is discharged inside the heat treatment apparatus 10. Although the heat treatment apparatus 10 is ventilated, an amount of ventilated air is not so large. For this reason, like the heated air which is discharged from the vertical heat treatment furnace 12, if a large amount of heated air is discharged inside the heat treatment apparatus 10 at once, ventilation will not be sufficient and the temperature inside the heat treatment apparatus 10 will become very high temporarily. Therefore, an amount of heat released from the housing 16 is increased.

When the above point is taken into consideration, it is preferable that the housing 16 is strengthened in its heat insulation partially and is provided with a cooling function. The honeycomb structure thermal insulator used in the above-mentioned first embodiment is suitable for such a thermal insulator.

Figure 10:
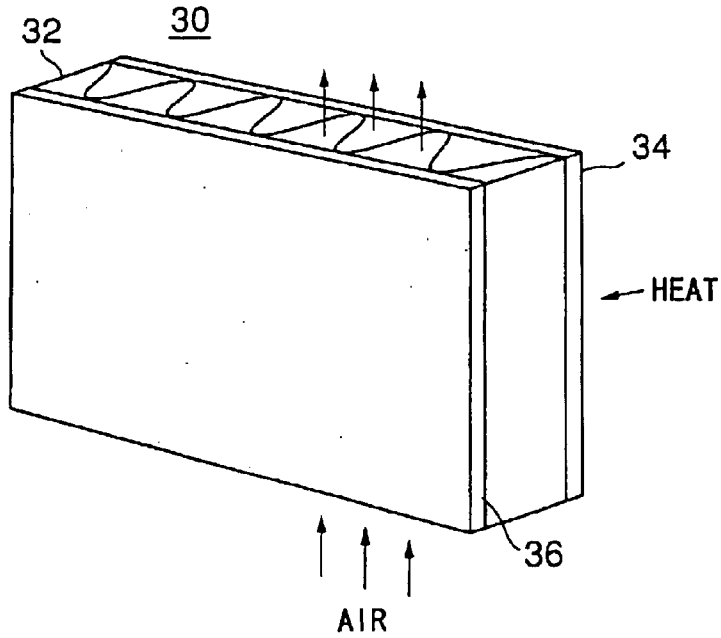
FIG. 10 is a perspective view of a honeycomb structure thermal insulator according to a second embodiment of the present invention.

FIG. 10 is a perspective view showing a structure of an example of the honeycomb structure thermal insulator used in the second embodiment of the present invention.

The honeycomb structure thermal insulator 30 shown in FIG. 10 is used for a panel of the housing 16, and, thus, an aluminum plate 34 is applied on a portion corresponding to an inner surface of the housing 16, which is a surface of the honeycomb structure 32. The aluminum plate 34 is provided to give a sufficient strength to the thermal insulator as a housing panel. In addition, the aluminum plate 34 has good thermal conductivity, and also has a function to distribute partial heating due to the radiation from semiconductor wafers to peripheral portions.

Moreover, a thermal insulation board 36 is provided outside the thermal insulator 30. Similar to the aluminum plate 34, the thermal insulation board 36 is provided to give a sufficient strength to the thermal insulator 36 as a housing panel.

In addition, the heat insulation board 36 also has a function to further strengthen the heat insulation of the honeycomb structure 32.

It should be noted that the aluminum plate 34 is not always needed, and a surface of the honeycomb structure may be exposed if a partial strengthening of the heat insulation can be achieved by changing the material or shape of the honeycomb structure.

In addition, an inner surface of the aluminum board 34, i.e., a surface close to the semiconductor wafers taken out of the vertical heat treatment furnace 12 is preferably in a color such as black so as to absorb a heat ray. This is because if a radiation of the semiconductor wafers is reflected, it takes a longer time to cool the semiconductor wafers. Moreover, when the aluminum plate 34 is not provided, it is preferable to make the honeycomb structure itself in black or a color similar to black.

Further, the heat insulation board 36 is also not always needed if it is not needed for the purpose of heat insulation.

Figure 11:
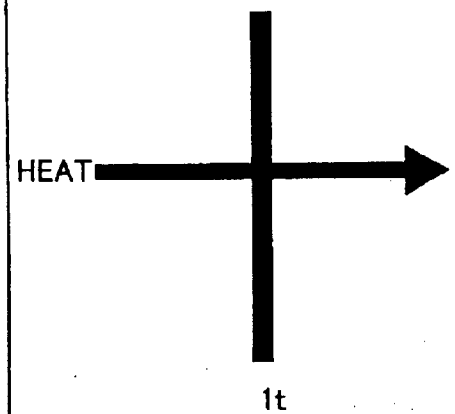
FIG. 11 is an illustration of a result of calculation with respect to an amount of heat released through various panels.
Figure 11:
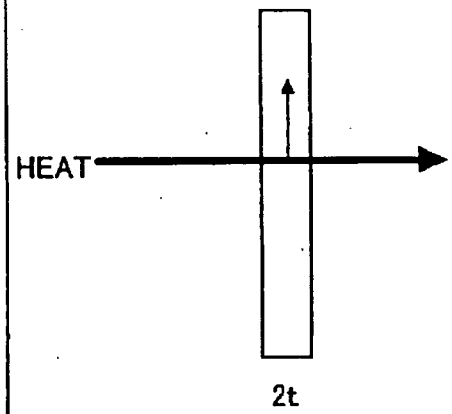
Figure 11:
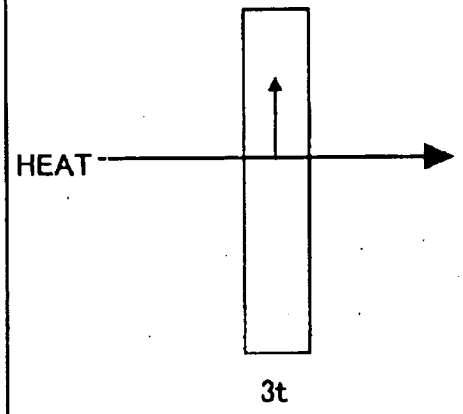

FIG. 11 shows a result of calculation with respect to an amount of heat released through a panel in a case in which a steel plate is used for a housing panel and in a case in which a honeycomb structure panel is used for a housing panel.

In FIG. 11, the case where a housing panel is formed by a steel plate having a thickness of 1 mm is indicated on the left side as a conventional technique. When a calculation was made to obtain an amount of heat released outside (outside of a clean room) through a steel plate on the assumption that a temperature inside the housing panel is 67° C. and a temperature outside the housing panel is 23° C., the amount of heat is 314 W per square meter. That is, an amount of heat of 270 kcal passes the steel plate per square meter for 1 hour, and is released to the clean room.

On the other hand, as a suggested technique 1, a calculation was made with respect a honeycomb structure panel. It was supposed that a thickness of the honeycomb structure panel is 2 mm, and similar to the conventional technique, a temperature inside the panel is 67° C. and a temperature outside is 23° C. When a calculation was made on the assumption that a cooling air is introduced into the honeycomb structure panel, the amount of heat passing the honeycomb structure panel is 241 W per square meter. That is, an mount of heat of 207 kcal passes through the honeycomb structure panel per square meter for 1 hour, and is released to a clean room.

Moreover, as a suggested technique 2, a calculation was made on the assumption that a thickness of the honeycomb structure panel according to the suggested technique 1 is 3 mm, the result of calculation indicated that the amount of heat passing through the panel is 56 W per square meter. That is, an amount of heat of 48 k cal passes through the honeycomb structure panel per square meter for 1 hour, and is released to a clean room.

As mentioned above, by replacing the conventional steel plate having a thickness of 1 mm with the honeycomb structure panel having a thickness of 3 mm, an amount of heat released to a clean room from the housing is reduced from 270 kcal/m2 to 48 kcal/m2. Moreover, the heat absorbed by the air flowing through the honeycomb structure panel can be collected and the collected heat can be recycled.

Figure 12:
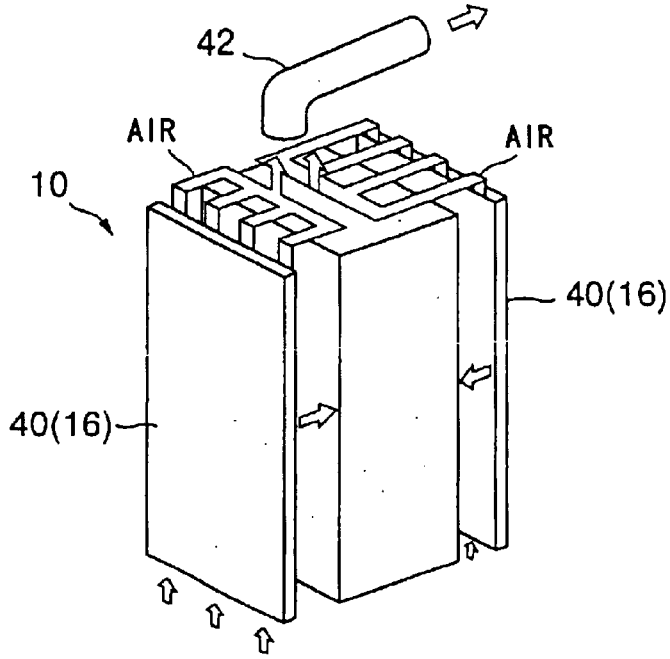
FIG. 12 is a schematic perspective view of a structure of a housing provided to the heat treatment apparatus.

FIG. 12 is a schematic perspective view of a structure in which the housing 16 of the heat treatment apparatus 10 is formed by honeycomb structure panels 40 so as to collect air flowing through the honeycomb structure panels by an exhaust duct. In the example shown in FIG. 12, each cell of the honeycomb structure panels 40 extends in a vertical direction. The air supplied from a lower part of the honeycomb structure panel 40 flows toward an upper part while absorbing the heat entering the honeycomb structure panel 40 (housing 16) when the air passing through an air passage formed by each cell of the honeycomb structure panels 40. The air reached an upper end of the honeycomb structure panels 40 is collected at one location by an air manifold (not shown in the figure), and the collected air is sent to a desired position through an exhaust passage 42. The collected air flowing into the exhaust passage 42 has been heated when being passed through the honeycomb structure panels 40, and, thus, the air can be reused as a heat source.

As mentioned above, by forming the housing 16 of the heat treatment apparatus 10 by the honeycomb structure panels 40 according to the present embodiment, the heat insulation can be strengthened entirely or partially, and also energy saving can be achieved by recovery and recycle of heat.

A description will now be given of a method of recycling heat recovered by the honeycomb structure thermal insulator according to the above-mentioned embodiments.

Heat collected from the honeycomb structure thermal insulators 22A or 22B according to the first embodiment of the present invention and heat collected from the honeycomb structure panel 40 according to the second embodiment of the present invention can be recycled as a heat source for heating other parts of the heat treatment apparatus 10. Since a coolant collected from the honeycomb structure thermal insulator provided around the vertical heat treatment furnace 12 absorbs a large amount of heat and are collected in a relatively high-temperature state, such a coolant is especially suitable as a heat source.

Figure 13:
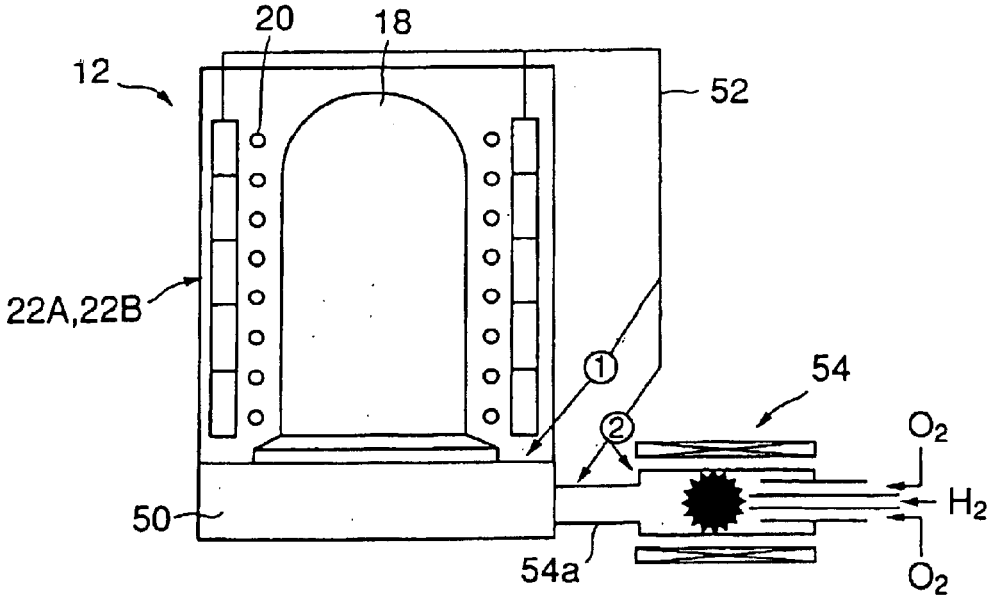
FIG. 13 is a schematic illustration of a heat recycle system for recycling heat recovered from the vertical heat treatment furnace.

A description will be given below, with reference to FIG. 13 and FIG. 14, of a heat recycle system for recycling heat recovered from the vertical heat treatment furnace 12. In FIG. 13, examples of two locations are indicated by arrows (1) and (2) as places at which the collected heat is used. The place of reusing the heat indicated by the arrows (1) is a manifold 50 provided in a lower part of the vertical heat treatment furnace 12. The manifold 50 is located under the wafer accommodation container 18 and serves to mix various kinds of gasses and introduce the mixture gas into the wafer accommodation container 18. If a temperature of the manifold 50 is low, a byproduct may adhere on an inner surface of the manifold 50 when material gases react. Moreover, there is a case in which a material gas is pyrolytically decomposed in the manifold 50. Thus, since the manifold 50 needs heating as mentioned above, the coolant heated by being passed through the honeycomb structure thermal insulator 22A or 22B is collected and supplied to the manifold 50 as indicated by the arrows (1) via a coolant supply passage 52 so as to recycle the heat as a heat source. As a heating means, a coolant pipe may be provided around the manifold 50.

The place of reusing heat indicated by the arrow (2) is an external combustion apparatus 54 connected to the manifold 50. The external combustion apparatus 54 is an apparatus which generates steam by reacting hydrogen gas ($H_2$) and oxygen gas ($O_2$) so as to supply the steam to the heat treatment furnace 12. In order to cause hydrogen gas ($H_2$) and oxygen gas ($O_2$) react with each other, heating is required, and the coolant supplied from the coolant supply passage 52 is used for the heating. Moreover, it is preferable to heat an exit 54*a* of the external combustion apparatus 54 so that the steam generated by the external combustion apparatus 54 is prevented from being liquefied by cooling in the vicinity of the exit 54*a*.

Figure 14:
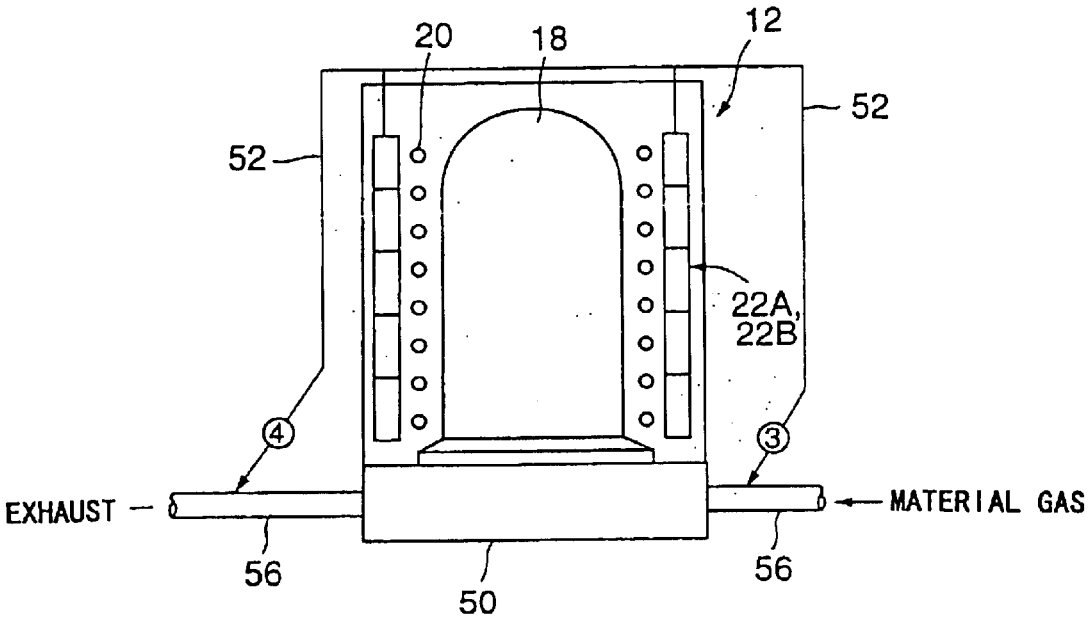
FIG. 14 is a schematic illustration of another heat recycle system for recycling heat recovered from the vertical heat treatment furnace.

Two more examples are shown in FIG. 14 by arrows (3) and (4) as places for reusing the heat. The place of reusing the heat indicated by the arrows (3) is a material gas supply passage 56 for supplying a material gas to the manifold 50. There is a case in which a material gas is required to be pyrolytically decomposed, and such a material gas is preferably preheated within the material gas supply passage 56.

Moreover, a material gas contains a gas, which is easily liquefied, and such a material gas is preferably heated so as to be prevent from being liquefied. The place of reusing the heat indicated by the arrows (4) is an exhaust passage 58 through which a gas exhausted from the manifold 50 flows. The gas exhausted from the manifold 50 is a mixture gas of material gasses, and a byproduct tends to adhere onto an inner surface of the exhaust passage 58. Thus, it is preferable to prevent adhesion of a byproduct by heating the exhaust passage 58. Although the coolant, which cools the air in the honeycomb structure thermal insulator, is used as a heat recovery medium in the above-mentioned heat recycle system, the air itself which circulates the interior of the honeycomb structure thermal insulator may be used as a heat recovery medium.

As mentioned above, the heat collected through the honeycomb structure thermal insulator 22A or 22B of the vertical heat treatment furnace 12 can be reused in various parts in the heat treatment apparatus 10, and it is not restricted to the parts shown in FIGS. 13 and 14. Moreover, it is also possible to reuse the heat in the exterior of the heat treatment apparatus 10. However, when an amount of reusable heat and piping for recycling, etc. are taken into consideration, it is preferable to reuse the heat within the heat treatment apparatus 10.

Moreover, although the examples shown in FIGS. 13 and 14 are the places of using the heat collected from the vertical heat treatment furnace 12, heat collected from the honeycomb structure panels 40 as a housing 16 shown in FIG. 12 can be reused in the parts shown in shown in FIGS. 13 and 14.

Although the honeycomb structure thermal insulator is used as a thermal insulator for the vertical heat treatment furnace, which is a batch processing apparatus, the honeycomb structure thermal insulator according to the present invention may be used for a single wafer processing apparatus, which processes wafers on an individual wafer basis.

Figure 15A:
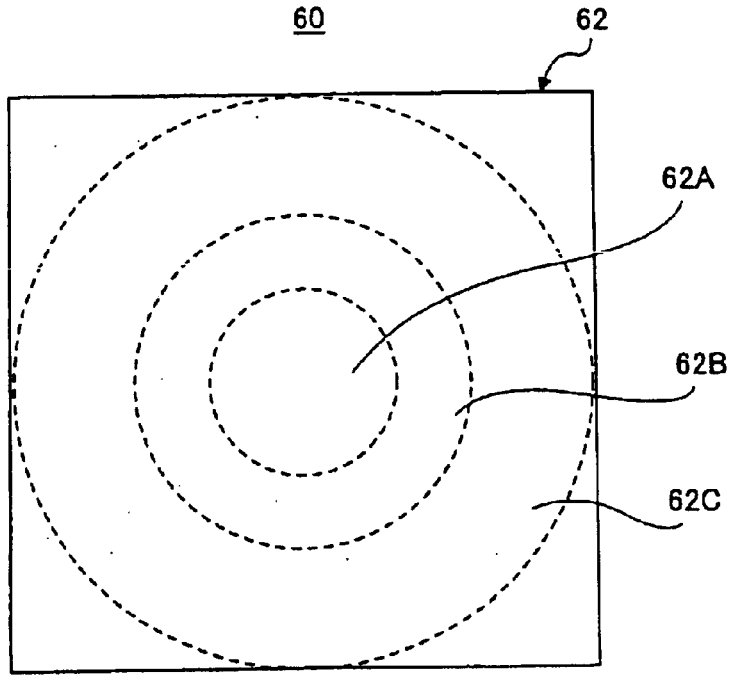
FIG. 15A is a plan view of a single-wafer processing type heat treatment furnace provided with a honeycomb structure thermal insulator according to the present invention.
Figure 15B:
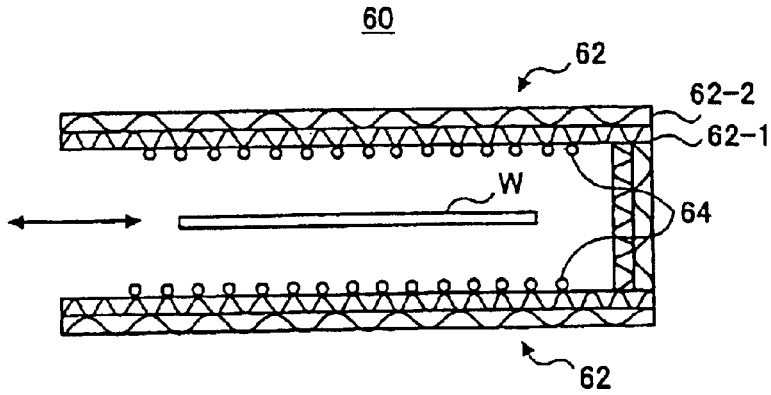
FIG. 15B is a cross-sectional view of the heat treatment furnace shown in FIG. 15A.

FIGS. 15A and 15B show an example using the honeycomb structure thermal insulator according to the present invention for a single-wafer processing type heat treatment furnace. FIG. 15A is a plan view of the heat treatment furnace, and FIG. 15B is a cross-sectional view of the heat treatment furnace.

Only one semiconductor wafer W is supplied to the heat treatment furnace 60 shown in FIGS. 15A and 15B as an object to be processed. After the processed semiconductor wafer W is taken out of the furnace 60: the semiconductor wafer W to be processed next is supplied to the heat treatment furnace 60. As shown in FIG. 15B, the heat treatment furnace 60 is covered by a thermal insulator 62 which consists of the honeycomb structure thermal insulator according to the present invention, and an electric heater for heating is provided inside the thermal insulator 62. Thermal insulator 62 is divided into two layers in the example shown in FIGS. 15A and 15B, and a pitch of honeycomb cells of an inner layer 62-1 is smaller than a pitch of honeycomb cells of an outer layer 62-2. This is for the purpose of giving a high thermal conductivity to the inner layer 62-1 so as to equalize the heat of the electric heater, and giving a high heat insulation characteristic to the outer layer 62-2 so as to intercept release of heat, as explained above with reference to FIG. 4. Moreover, as explained with reference to FIG. 4, the materials of the inner layer 62-1 and the outer layer 62-2 may be different from each other. Further, the thermal insulator 62 may have a multilayered structure having three layers or more.

Additionally, as indicated by a dotted line in FIG. 15A, the heat insulation panel 62 may be divided horizontally, and the material and shape of the honeycomb structure thermal insulator of each area may be varied so as to obtain a desired heat conductivity and heat insulation characteristic. For example, an area 62A corresponding to the center portion of the semiconductor wafer is formed of a honeycomb structure thermal insulator of which heat conductivity is considered as an important factor so that heat from the heater 64 is uniformly distributed over the entire wafer W. On the other hand, an area 62C corresponding to a periphery of the wafer W is formed of a honeycomb structure thermal insulator of which heat insulation characteristic is considered as an important factor so as to reduce a difference in temperature between the inner part due to release of heat. An area 62B between the area 62A and the area 62C is provided with a honeycomb structure thermal insulator for adjusting a difference in thermal expansion rate between the area 62A and the area 62C.

The horizontal division of the thermal insulator 62 is not limited to the concentric areas shown in FIG. 15A, and the concentric areas may be further divided in a circumferential direction or divided into other forms. For example, only a part of the heat treatment furnace 60 especially requiring heat insulation may be provided with a honeycomb structure thermal insulator of which heat insulation characteristic is considered as an important factor.

The present invention is not limited to the specifically disclosed embodiments, and variations and modifications may be made without departing from the scope of the present invention.

The present application is based on Japanese priority applications No. 2000-402104 filed on Dec. 28, 2000 and No. 2001-386110 filed on December 19, the entire contents of which are hereby incorporated by reference.

What is claimed is:

1. A heat treatment apparatus comprising:

a heat source adapted to generate heat to apply a heat treatment to an object to be processed; and a honeycomb structure thermal insulator configured and arranged to intercept the heat generated by the heat source, the honeycomb structure thermal insulator including a plurality of partitions defined by dividing the honeycomb structure thermal insulator in accordance with a temperature of the heat source, wherein the plurality of partitions are made of different materials to provide different heat insulation characteristics.

2. The heat treatment apparatus as claimed in claim 1, wherein each of the different materials in the plurality of partitions of the honeycomb structure thermal insulator contains a mixture of alumina fiber and silica fiber, and the different materials in the plurality of partitions have different compositions obtained by varying a mixing ratio of the alumina fiber and the silica fiber.

3. The heat treatment apparatus as claimed in claim 1, further comprising an air supply configured to supply air to the honeycomb structure so that each cell of the honeycomb structure serves as an air passage.

4. The heat treatment apparatus as claimed in claim 3, further comprising a coolant passage through which a coolant flows to cool the air flowing through the air passage defined by each cell.

5. The heat treatment apparatus as claimed in claim 1, wherein the heat source is an electric heater provided around a vertical heat treatment furnace, the honeycomb structure thermal insulator has a cylindrical shape to substantially enclose the electric heater, and the honeycomb structure thermal insulator is divided into the plurality of partitions in a radial direction of the honeycomb structure thermal insulator.

6. The heat treatment apparatus as claimed in claim 1, wherein the heat source is an electric heater provided around a vertical heat treatment furnace, the honeycomb structure thermal insulator has a cylindrical shape to substantially enclose the electric heater, and the honeycomb structure thermal insulator is divided into the plurality of partitions in a vertical direction of the honeycomb structure thermal insulator.

7. The heat treatment apparatus as claimed in claim 6, wherein the plurality of partitions are defined by dividing the honeycomb structure thermal insulator in accordance with heat control zones of the electric heater.

8. A heat treatment apparatus comprising:

a heat source adapted to generate heat to apply a heat treatment to an object to be processed; and a honeycomb structure thermal insulator configured and arranged to intercept the heat generated by the heat source, the honeycomb structure thermal insulator including a plurality of partitions defined by dividing the honeycomb structure thermal insulator in accordance with a temperature of the heat source, wherein the plurality of partitions have different heat insulation characteristics established by varying a weight per unit volume of the honeycomb structure thermal insulator.

9. The heat treatment apparatus as claimed in claim 8, wherein the weight per unit volume of the honeycomb structure thermal insulator is established by changing a cell pitch of the honeycomb structure thermal insulator.

10. The heat treatment apparatus as claimed in claim 8, further comprising an air supply configured and arranged to supply air to the honeycomb structure thermal insulator, wherein each cell of the honeycomb structure serves as an air passage.

11. The heat treatment apparatus as claimed n claim 10, further comprising a coolant passage through which a coolant flows to cool the air flowing through the air passage defined by each cell.

12. The heat treatment apparatus as claimed in claim 8, wherein the heat source is an electric heater provided around a vertical heat treatment furnace, the honeycomb structure thermal insulator has a cylindrical shape to substantially enclose the electric heater, and the honeycomb structure thermal insulator is divided into the plurality of partitions in a radial direction of the honeycomb structure thermal insulator.

13. The heat treatment apparatus as claimed in claim 8, wherein the heat source is an electric heater provided around a vertical heat treatment furnace, the honeycomb structure thermal insulator has a cylindrical shape so as to substantially enclose the electric heater, and the honeycomb structure thermal insulator is divided into the plurality of partitions in a vertical direction of the honeycomb structure thermal insulator.

14. The heat treatment apparatus as claimed in claim 13, wherein the plurality of partitions are defined by dividing the honeycomb structure thermal insulator in accordance with heat control zones of the electric heater.

* * * * *